US009695035B2

(12) United States Patent
Dejong et al.

(10) Patent No.: US 9,695,035 B2
(45) Date of Patent: Jul. 4, 2017

(54) MOUNTING ASSIST DEVICE AND METHOD

(71) Applicant: Hairy Back Ranch Inc., Surrey (CA)

(72) Inventors: Randell Dejong, Surrey (CA); Paul Tontsch, Langley (CA)

(73) Assignee: Hairy Back Ranch Inc., Surrey, CA (US)

( * ) Notice: Subject to any disclaimer, the term of this patent is extended or adjusted under 35 U.S.C. 154(b) by 0 days.

(21) Appl. No.: 14/898,102

(22) PCT Filed: Jun. 18, 2014

(86) PCT No.: PCT/IB2014/062311

§ 371 (c)(1),
(2) Date: Dec. 11, 2015

(87) PCT Pub. No.: WO2014/207608

PCT Pub. Date: Dec. 31, 2014

(65) Prior Publication Data

US 2016/0115012 A1 Apr. 28, 2016

Related U.S. Application Data

(60) Provisional application No. 61/839,268, filed on Jun. 25, 2013.

(51) Int. Cl.
*B68C 3/02* (2006.01)
*B68C 3/00* (2006.01)

(52) U.S. Cl.
CPC ..... *B68C 3/02* (2013.01); *B68C 3/0016* (2013.01); *B68C 2003/0083* (2013.01)

(58) Field of Classification Search
CPC ... B68C 3/00; B68C 3/0016; B68C 2003/005; B68C 2003/0058; B68C 2003/0075; B68C 2003/0083; B68C 3/02
(Continued)

(56) References Cited

U.S. PATENT DOCUMENTS 16,032 A * 11/1856 Trussell ..... B68C 3/02 236/1 R
83,822 A 11/1868 Bennett
(Continued)

FOREIGN PATENT DOCUMENTS

DE 77019 C 3/1894
DE 8707248 A 4/1986
(Continued)

OTHER PUBLICATIONS

Smartrider—Breakaway Stirrup Specialists. Accessed Jan. 23, 2013. 2 pages. <http://www.smartrider.net/>.
(Continued)

*Primary Examiner* — Lisa Tsang
(74) *Attorney, Agent, or Firm* — Oyen Wiggs Green & Mutala LLP

(57) ABSTRACT

A foldable stirrup for mounting animals such as horses has a support arm for engagement with a stirrup leather and a base pivotaly coupled to the support arm for supporting a rider's foot while mounting when the stirrup is in an open configuration. The base and the support arm are inwardly foldable together to a folded configuration. A mounting assist strap configured to engage the stirrup and provide a point of securement on the animal to be mounted is provided. Methods of mounting an animal using the foldable stirrup and mounting assist strap are provided.

15 Claims, 9 Drawing Sheets

(58) Field of Classification Search
USPC ..... 54/47–49, 49.5, 1
See application file for complete search history.

(56) References Cited

U.S. PATENT DOCUMENTS

| | | | | |
|---|---|---|---|---|
| 211,668 | A * | 1/1879 | Pulliam | B68C 3/0016 54/49 |
| 756,270 | A * | 4/1904 | McVey | B68C 3/00 54/47 |
| 830,114 | A * | 9/1906 | Turner | B68C 3/00 54/47 |
| 4,209,962 | A * | 7/1980 | Forest | B68C 3/02 54/49 |
| 4,281,503 | A | 8/1981 | Teel | |
| 4,402,385 | A | 9/1983 | Buche | |
| 4,601,161 | A * | 7/1986 | Drellich | B68B 1/00 54/46.1 |
| D370,091 | S * | 5/1996 | Simmons | D30/142 |
| D680,279 | S | 4/2013 | DeJong | |
| 9,428,376 | B2 * | 8/2016 | McInulty | B68C 3/02 |
| 2005/0229552 | A1 | 10/2005 | Dubourg | |
| 2009/0266039 | A1 | 10/2009 | Gottlieb | |
| 2010/0162670 | A1 * | 7/2010 | Bostock | B68C 3/02 54/49 |

FOREIGN PATENT DOCUMENTS

| | | | |
|---|---|---|---|
| EP | 0193669 | A1 | 9/1986 |
| EP | 2030946 | A1 | 8/2008 |
| FR | 2663017 | A1 | 12/1991 |
| FR | 2880340 | A1 | 7/2006 |
| FR | 2915983 | A3 | 11/2008 |
| GB | 14094 | | 0/1909 |

OTHER PUBLICATIONS

Stubben Steeltec Horseback Riding Stirrups Recalled Due to Fall Hazard. U.S. Consumer Product Safety Commission Accessed Jan. 23, 2013. 2 pages. <http://www.cpsc.gov/cpscpub/prerel/prhtml107/07264.html>.

* cited by examiner

MOUNTING ASSIST DEVICE AND METHOD

REFERENCE TO RELATED APPLICATIONS

This application is a 371 of Patent Cooperation Treaty international application No. PCT/IB2014/062311 filed 18 Jun. 2014, which claims the benefit of U.S. provisional patent application No. 61/839268 filed 25 Jun. 2013, both of which are incorporated by reference herein.

TECHNICAL FIELD

Some embodiments of the present invention pertain to devices and methods for assisting a rider to mount an animal such as a horse. Some embodiments of the present invention provide portable devices and methods of using same for assisting a rider to mount an animal such as a horse.

BACKGROUND

Equestrian sports are popular activities. In many equestrian sports, a rider is mounted on a horse and rides the horse to participate in the sport or ride casually. In many equestrian sports, a saddle is used to support the rider while mounted on the horse. Most saddles include stirrups to support the rider's feet while mounted. Stirrups are supported by the saddle via stirrup leathers, generally elongate pieces of material (typically leather) that can be anchored on the saddle and coupled to or through appropriate points on the stirrups. Frequently, a rider mounts the horse by inserting a first foot (typically the left foot) into a corresponding one of the stirrups of the saddle, and swings his/her body and free leg up over the horse's back to assume a seated position in the saddle.

Mounting a horse can be difficult for many riders, even when a saddle is used. For example, the height of a saddle on a horse may be such that riders may have difficulty lifting their body over the saddle to mount the horse, may have difficulty reaching the stirrup on the side from which the horse is to be mounted from the ground, or must exert such a force on the saddle to pull themselves up into a mounted position that it is undesirable for them to do so (for example, it may cause discomfort to the horse or bend the tree of the saddle).

If a horse is to be ridden without a saddle, for example because it is desired to ride the horse bareback, the difficulty faced by the rider in mounting the horse is amplified. Typically, to mount a horse bareback, a rider must jump up to place his or her body on the horse's back near the horse's wither, lift one foot over the horse's back so that the rider is straddling the horse, and then lift his/her body up and rearrange the body position longitudinally with respect to the horse so that the rider is in a proper seated position astride the horse (usually adjacent the horse's wither). It can be difficult or awkward for many riders to mount a horse without a saddle.

There are many different devices and methods that can be used to assist riders to mount horses or other four-legged animals. For example, a rider may receive a leg up (i.e. boost) from another person, the rider may mount the horse from a step stool or other inanimate object, the rider may lower the stirrup on the side of the saddle from which the horse is to be mounted to make it easier for the rider to reach the stirrup from the ground (although once mounted it can be difficult to readjust a saddle stirrup to the correct position for riding), or the like. A disadvantage of receiving a leg up from another person is that the other person must be present and unmounted where the rider is mounting. A disadvantage of using a step stool is that it is typically not portable, meaning the rider can only conveniently mount the horse where the step stool is located.

Other animals besides horses may be ridden by humans. For example, humans may ride animals such as a cow, bull, ox, water buffalo, camel, llama, emu, ostrich, or the like.

There remains a need for improved devices and methods to assist riders to mount horses and other animals, including methods and devices that can be used to assist the rider to mount an animal without a saddle.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One embodiment provides a foldable stirrup for mounting animals having a support arm for engagement with a strap and a base pivotally coupled to the support arm for supporting a rider's foot while mounting the animal when the stirrup is in an open configuration, the base and the support arm being inwardly foldable together into a folded configuration. The support arm and the base can be coupled together by a revolute joint. The support arm and the base can be coupled together by engagement of a pin through a pair of aligned apertures in the base and in the support arm. In some embodiments, the maximum angle that can be defined between the support arm and the base is approximately 90°.

One embodiment provides a mounting aid having a foldable stirrup as defined above or in this specification and a mounting assist strap. The mounting assist strap has a first end configured to provide a shoulder loop and a second end configured to engage with the support arm of the foldable stirrup. The mounting assist strap can have a clip at the first end and a securement point spaced apart from the clip, the clip being engageable with the securement point, and the clip and the securement point being spaced apart by a distance to provide the shoulder loop when the clip is secured to the securement point.

One embodiment provides a kit having a foldable stirrup as defined herein, a mounting assist strap as defined herein, and a waist pack dimensioned and configured to receive both the mounting assist strap and the foldable stirrup when the foldable stirrup is in the folded configuration.

One embodiment provides a method of mounting an animal. A foldable stirrup having a base and a support arm pivotally coupled to the base are provided. A mounting assist strap having a first end configured to provide a shoulder loop and a second end configured to engage with the support arm of the foldable stirrup is provided. The mounting assist strap is laid across the back of the animal. The shoulder loop at the first end of the mounting assist strap is engaged with the shoulder of the animal. The foldable stirrup is moved to an open configuration. The support arm of the foldable stirrup is engaged with the second end of the mounting assist strap. The rider can then insert one foot into the stirrup and swing his or her second leg over the animal to place the rider in a seated position astride the animal. The rider can then remove the first foot from the stirrup, remove the support arm of the stirrup from the second end of the mounting assist strap, fold the support arm and the base of the stirrup inwardly together to place the stirrup in a folded configuration, remove the shoulder loop from the shoulder of the animal, remove the mounting assist strap from the back of the animal, and optionally store the stirrup and the mounting assist strap in a waist pack or backpack.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Some embodiments of the present invention provide a mounting strap and folding stirrup that can be used to mount an animal such as a horse. A first end of the mounting strap can be placed around one of the horse's forelegs and corresponding shoulder area to provide a point of support for mounting the horse. The strap includes a loop or other attachment point at its second end for engaging with a folding stirrup. The strap can be secured around the horse's foreleg, with the second end of the strap passed up and over the horse's withers. The first end of the strap thus provides a shoulder loop, and engagement of the shoulder loop with the horse's shoulder acts as a counterbalance to the weight of the rider mounting the horse. The stirrup can be engaged in its open configuration with the second end of the strap, and a rider can use the stirrup in conventional manner by inserting a first foot in the stirrup and swinging a second foot over the back of the horse to place the rider in a seated position. The rider can then remove his or her foot from the stirrup, fold the support arm and base of the stirrup inwardly together for storage, and remove the strap from the horse's foreleg. In some embodiments, a waist pack is provided so that the rider can store the folded stirrup and strap in the waist pack for transporting and/or carrying the stirrup and strap while riding the horse.

While the exemplary embodiments described herein are described with reference to mounting a horse, it will be apparent to one skilled in the art that the folding stirrup and mounting assist strap described herein could be used to mount any large animal, such as a cow, bull, ox, water buffalo, camel, llama, emu, ostrich, or the like.

Figure 1:
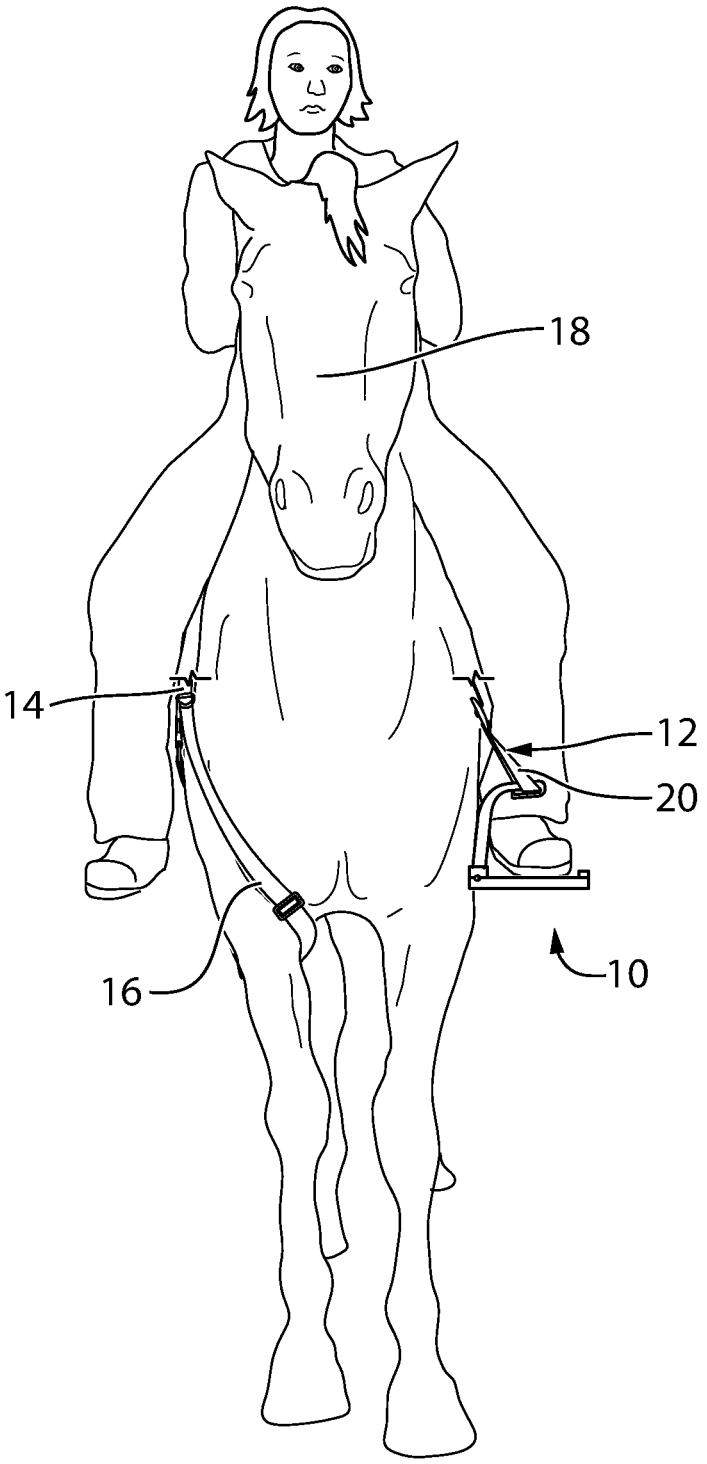
FIG. 1 is a front view of a rider mounted on a horse outfitted with a folding stirrup and mounting assist strap according to an example embodiment.

With reference to FIG. 1, in one exemplary embodiment, a foldable stirrup 10 is provided. Foldable stirrup 10 is engageable with a mounting assist strap 12. Mounting assist strap 12 has a first end 14 that can provide a shoulder loop 16 for engaging around a foreleg of a horse 18 or other animal, and a second end 20 that can be engaged with the foldable stirrup 10.

Figure 2:
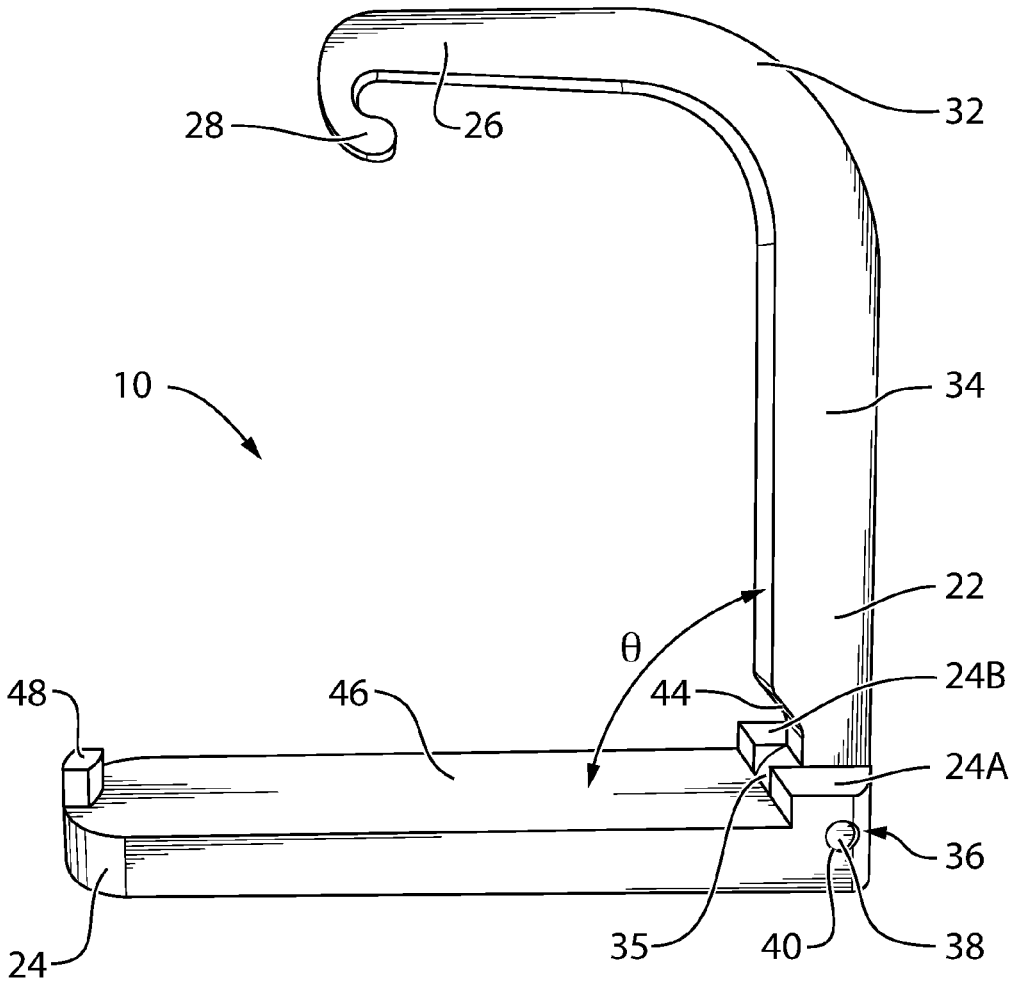
FIG. 2 is a front view of a folding stirrup according to an example embodiment in an open configuration.
Figure 3:
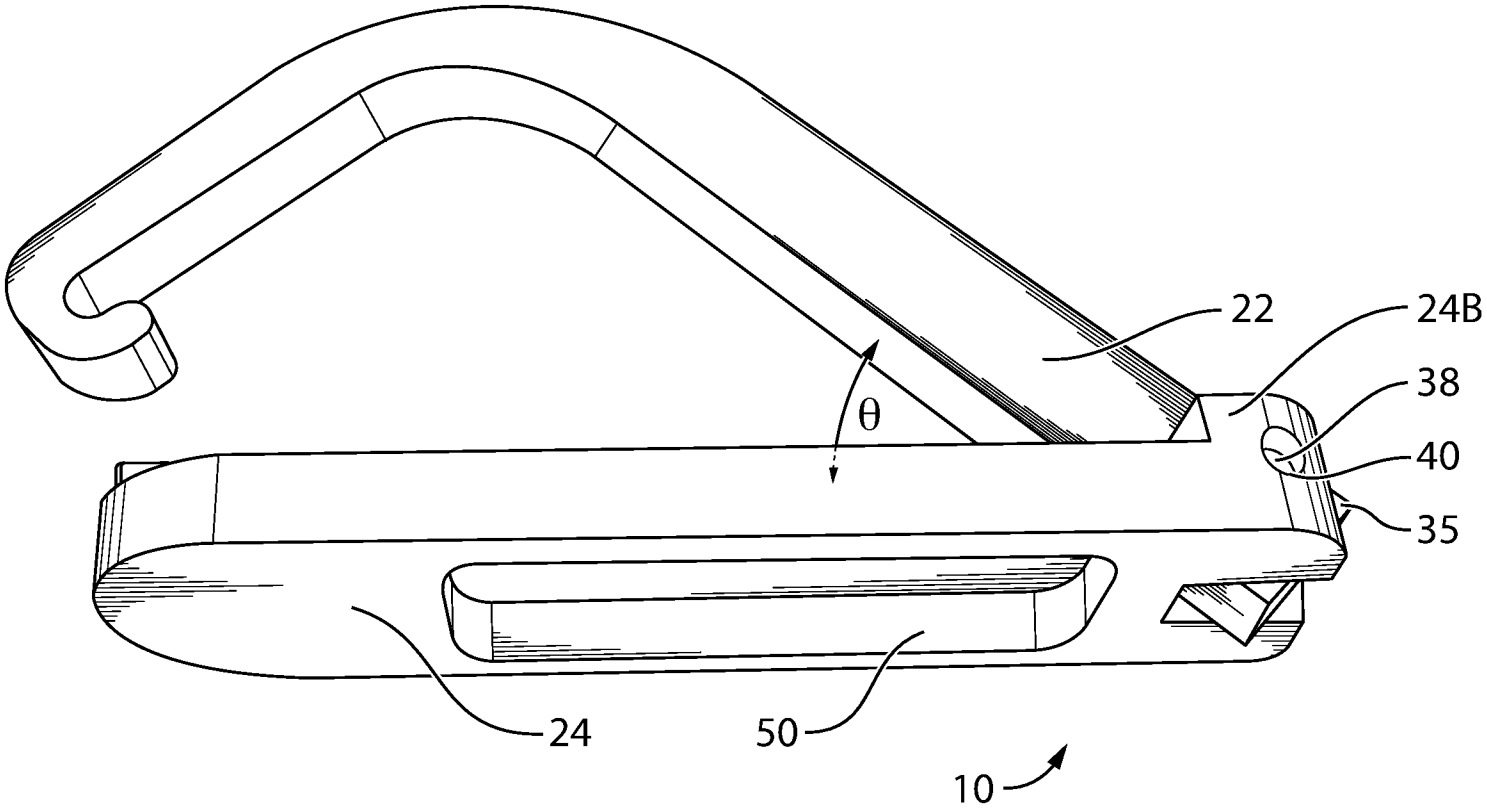
FIG. 3 is a perspective view of the embodiment of FIG. 2 in a folded configuration.

An exemplary embodiment of a foldable stirrup 10 is illustrated in greater detail in FIGS. 2 and 3. FIG. 2 shows foldable stirrup 10 in the open configuration, and FIG. 3 shows foldable stirrup 10 in the folded configuration. Foldable stirrup 10 includes a support arm 22 pivotally connected to a base 24. Support arm 22 has an attachment point at its first end 26 for connection to second end 20 of mounting assist strap 12. In the illustrated embodiment, the attachment point is provided by a hook 28 that can be slid inside a loop 30 (FIG. 5) provided at the second end 20 of mounting assist strap 12 and secured in place by engaging with strap 12 to secure foldable stirrup 10 in place. In some embodiments, hook 28 can be engaged with a conventional stirrup leather, for example on a conventional saddle with the conventional stirrups removed.

In some embodiments, support arm 22 is pivotally coupled to base 24 so that support arm 22 can be rotated inwardly from the open configuration shown in FIG. 2 toward base 24, to fold stirrup 10 into a compact configuration (i.e. a folded configuration) shown in FIG. 3. In some embodiments, support arm 22 can be folded inwardly towards base 24 so that an angle θ defined between support arm 22 and base 24 approaches an angle of between about 10° and about 30° or any angle therebetween, e.g. 15°, 20°, or 25°.

Support arm 22 is curved or otherwise angled or shaped along its length so that support arm 22 can support base 24 in an orientation generally parallel to the ground (i.e. generally horizontally) while leaving room for a rider's foot to be inserted in the space defined between support arm 22 and base 24 when stirrup 10 is supported by mounting assist strap 12 or by a conventional stirrup leather on a saddle. In the illustrated embodiment, support arm 22 includes an arched portion 32 that allows first end 26 of support arm 22 to extend in a direction along its length generally perpendicular to second end 34 of support arm 22. Support arm 22 could have any desired shape or length, but should be shaped so that a rider can easily insert his or her foot into the open area defined between support arm 22 and base 24, and so that base 24 will be supported at an angle that is approximately horizontal (e.g. parallel to or nearly parallel to the ground, assuming the ground is flat) when the stirrup is in the open configuration. For example, in some embodiments, arched portion 32 could be generally square in shape instead of curved.

Figure 4:
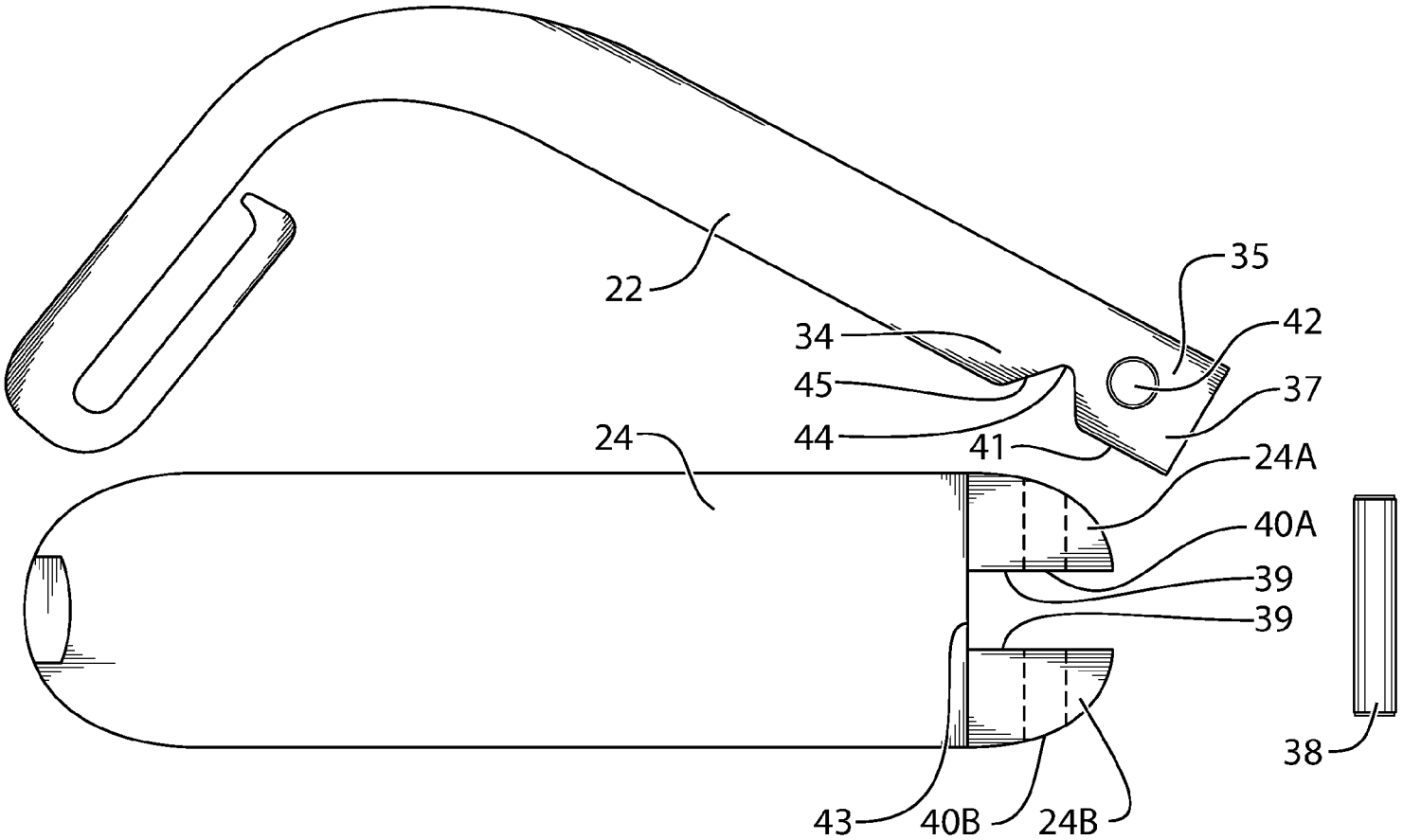
FIG. 4 shows the component pieces of a second embodiment of a folding stirrup.

With reference to FIG. 4, second end 34 of support arm 22 is pivotally coupled to base 24 in any suitable manner. In the illustrated embodiment, second end 34 of support arm 22 is pivotally coupled to base 24 by a revolute joint, indicated generally by 36 (FIG. 2). Revolute joint 36 is provided by the engagement of a pin 38 within aligned apertures 40A/40B (collectively apertures 40) and 42 through base 24 and second end 34 of support arm 22, respectively. In some embodiments, revolute joint 36 allows only one degree-of-freedom, i.e. base 24 and support arm 22 are constrained against any sort of significant relative lateral or torsional motion, and are only permitted to rotate relative to one another along an axis defined by the longitudinal axis of pin 38.

In the illustrated embodiment, the tip 35 of second end 34 of support arm 22 is received between two projecting portions 24A, 24B of base 24. Contact between the outer surfaces 37 of tip 35 and the inner surfaces 39 of projecting portions 24A, 24B of base 24 prevents support arm 22 from moving laterally relative to base 24 in a direction along the longitudinal axis of pin 38, and also prevents relative torsional motion of support arm 22 and base 24. Pin 38 restrains base 24 and support arm 22 against relative vertical motion or motion in the plane of base 24 (including, for example, in a direction perpendicular to the longitudinal axis of pin 38), and permits motion in only one degree-of-freedom, i.e. support arm 22 and base 24 are permitted to rotate relative to one another around the longitudinal axis of pin 38.

In some embodiments, a small gap is provided between outer surface 37 of the tip 35 of the second end 34 of support arm 22 and inner surfaces 39 of projecting portions 24A and 24B to allow smooth rotation about revolute joint 36.

In some embodiments, support arm 22 and base 24 are configured so that the maximum angle θ that can be defined between support arm 22 and base 24 is approximately 90°. In the illustrated embodiment, angles θ greater than about 90° cannot be achieved because inner edge 41 of tip 35 of support arm 22 squarely abuts inner edge 43 of base 24 defined between projections 24A and 24B. The engagement between generally flat surfaces 41 and 43 when angle θ approaches 90° prevents base 22 from rotating further to define an even larger angle θ. This prevents base 24 from swinging downwardly toward the ground (thereby potentially causing the rider's foot to slip out of stirrup 10) when a rider mounts the horse using stirrup 10. While inner edges 41 and 43 have been illustrated as generally flat surfaces, other shapes of inner edges 41 and 43 are possible, so long as the two surfaces are shaped so that relative movement of the two surfaces to allow angle θ to increase significantly beyond 90° is prevented.

In some embodiments, the portion of second end 34 of support arm 22 that is proximate to base 24 when stirrup 10 is in the folded configuration is shaped to allow angle θ to be decreased below about 90° without having support arm 22 interfere with base 24. In the illustrated embodiment, a cut-away portion 44 is provided in second end 34 near tip 35, to allow a smaller angle θ to be reached before second end 34 of support arm 22 makes contact with base 24 when stirrup 10 is being folded. As can be seen in FIGS. 3 and 4, in the folded configuration, cut-away portion 44 allows support arm 22 to be folded inwardly to a greater extent (i.e. permits a smaller angle θ to be reached in the folded configuration) before support arm 22 makes contact with base 24 than would be the case if cut-away portion 44 was omitted. In some embodiments, cut-away portion 44 is provided with a catch surface 45, that prevents further inward rotation of support arm 22 and base 24 once the stirrup 10 has been placed in the folded configuration.

Base 24 of stirrup 10 is configured to receive a rider's foot when stirrup 10 is used to mount a horse or other animal. In the illustrated embodiment, base 24 has a generally flat upper surface 46 for receiving the rider's foot. Base 24 could be provided in any desired shape, so long as the shape of base 24 does not make it unduly difficult for a rider to use the stirrup. In some embodiments, the upper surface of base 24 could be imprinted with a tread pattern and/or provided with a rubber or plastic tread, to increase the friction between a rider's boot or foot and stirrup 10 when stirrup 10 is being used to mount a horse.

In some embodiments, base 24 includes an upwardly extending projection 48 at or near the end of base 24 opposite support arm 22. Projection 48 can assist in preventing a rider's foot from slipping off base 24 when stirrup 10 is being used to mount a horse.

In the illustrated embodiment, foldable stirrup 10 does not have an outside arm, i.e. there is an open space between the outside edge of base 24 and the first end 26 of support arm 22. In some embodiments, this configuration provides a safety feature, allowing the rider's foot to be readily released from foldable stirrup 10 in the event that the rider falls off the horse. In some embodiments, foldable stirrup 10 could be provided with an outside arm to provide a fully closed stirrup similar in nature to a conventional stirrup, and in some such embodiments, the outside arm could be foldably joined to base 24 to allow both support arm 22 and the outside arm to be folded against base 24 to place the foldable stirrup 10 in the folded configuration.

With reference to FIG. 3, in some embodiments, the base 24 of stirrup 10 can include a cut-away or hollow portion, or even an aperture therethrough, to reduce the weight of stirrup 10 and/or to reduce the amount of material required to manufacture stirrup 10. In the illustrated embodiment of FIG. 3, an indentation 50 is provided in base 24 to reduce the amount of material used to make stirrup 10. Other configurations could be used to reduce the weight of and/or amount of material used to make stirrup 10, e.g. providing a plurality of apertures therethrough, providing a plurality of indentations therein that are smaller than indentation 50, or the like.

Figure 5:
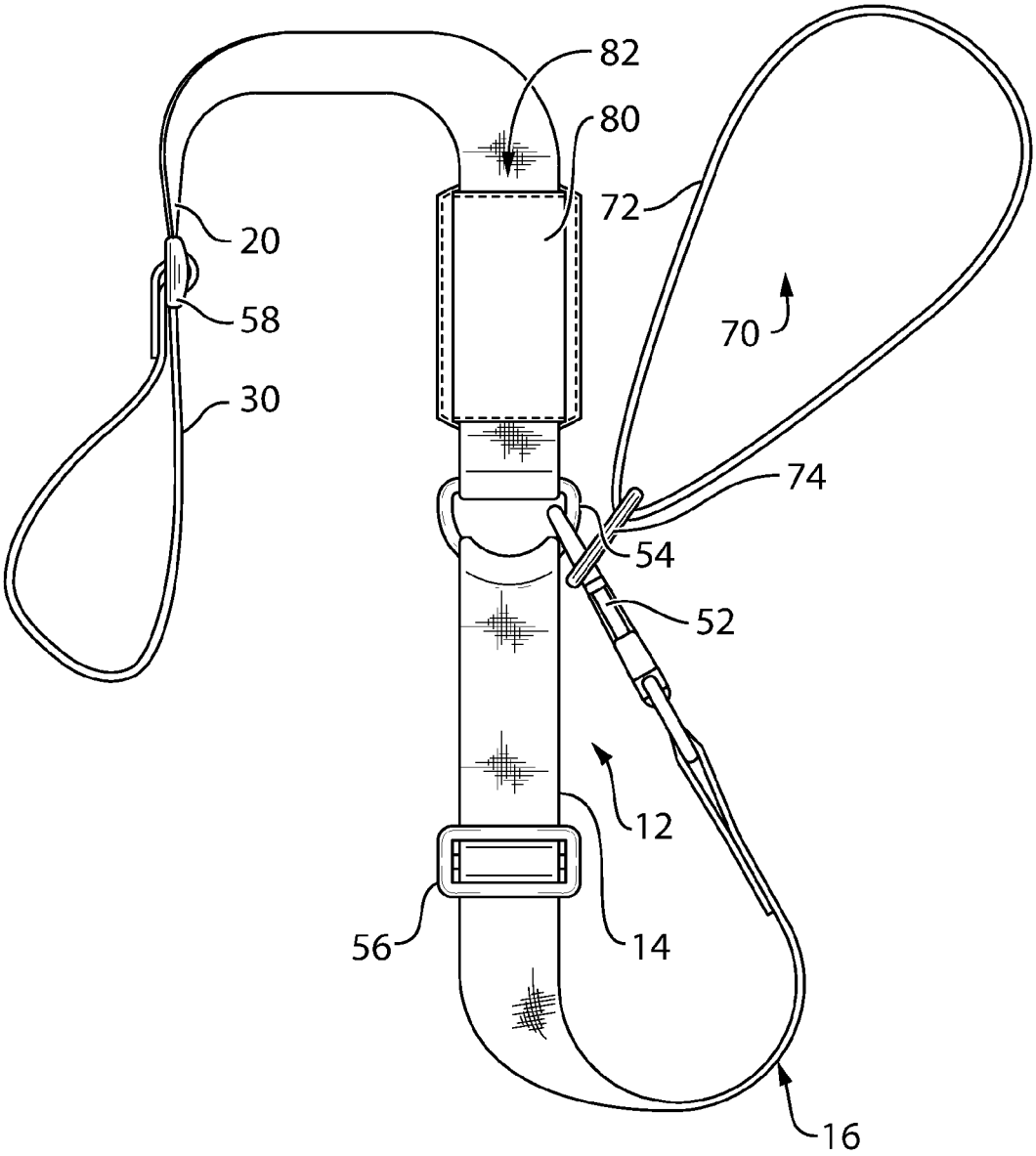
FIG. 5 shows a mounting assist strap according to an example embodiment.

With reference to FIG. 5, a mounting assist strap 12 according to an example embodiment is illustrated. First end 14 of mounting assist strap 12 is used for anchoring the mounting assist strap to the animal to be mounted. In the illustrated embodiment, strap 12 has a clip 52 at the end of first end 14 and a securement point 54 at a suitable location along strap 12 to provide a length of material sufficient to form a loop around a shoulder of the animal. In use, clip 52 can be engaged with securement point 54. In some embodiments, securement point 54 is a circular ring or a D-ring (as in the illustrated embodiment). A shoulder loop, indicated generally as 16, can be formed by laying strap 12 over a horse or other animal's back, reaching between the horse's forelegs and pulling first end 14 between the horse's forelegs, then securing clip 52 to securement point 54, thereby encircling the horse's foreleg and shoulder. Shoulder loop 16 provides a point of securement on the horse to allow a rider to mount the horse using stirrup 10 and strap 12.

Second end 20 of mounting strap 12 is used to support stirrup 10 in use. In the illustrated embodiment, second end 20 includes a loop 30 that can be used to secure stirrup 10 during use. When a shoulder loop 16 has been formed by engaging strap 12 around a horse's foreleg and securing clip 52 to securement point 54, strap 12 can extend over the horse's back near the wither, allowing loop 30 to hang freely by the horse's side so that it is available for securing stirrup 10.

In some embodiments, adjustment portions can be included within strap 12, to allow adjustment for different rider heights and preferences, and/or for different sizes of horses. In the illustrated embodiment of FIG. 5, strap 12 includes one adjustment slide 56 in first end 14, and one adjustment slide 58 in second end 20. Adjustment slide 56 allows for adjustment of the size of the shoulder loop 16 formed by engagement of clip 52 with securement point 54, while adjustment slide 58 allows for adjustment of the length of second end 20 of strap 12, thereby permitting adjustment of the height of loop 30, which determines the vertical position of stirrup 10 in use.

Figure 6:
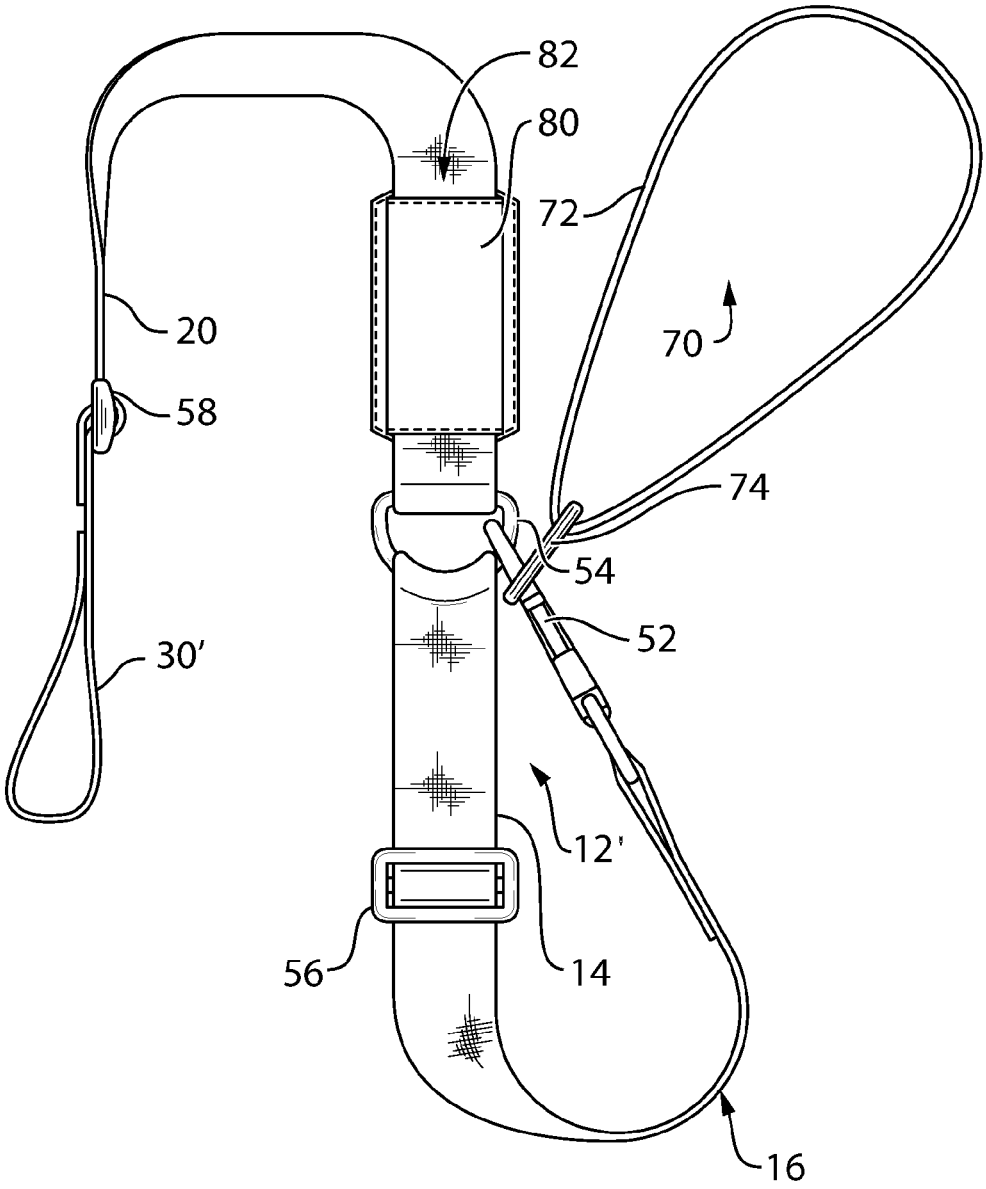
FIG. 6 shows a mounting assist strap according to a further example embodiment.

In the embodiment of a mounting assist strap 12' illustrated in FIG. 6, like reference numerals indicate like portions that are the same as mounting assist strap 12. Mounting assist strap 12' differs from mounting assist strap 12 in that a loop 30' for securing stirrup 10 is permanently sewn or otherwise formed in second end 20 of strap 12'. Adjustment slide 58 sits outside of loop 30', and can be used to adjust the height of loop 30' above the ground without changing the dimensions of loop 30'.

In some embodiments, strap 12 is provided with an optional handle 70. In some embodiments, handle 70 is detachable. In the illustrated embodiment of FIGS. 5 and 6, handle 70 has a hand loop 72, which is connected to an attachment point 74. Handle 70 could be made of any suitable material, for example nylon webbing, rubber, rope, soft plastic or the like. In the illustrated embodiment, hand loop 70 is made from nylon webbing. Attachment point 74 is provided by a metal ring, which is a D-ring in some embodiments. Attachment point 74 could be made of any suitable material, for example hard rubber or plastic, or omitted in some embodiments.

In some embodiments, attachment point 74 is detachably coupled to securement point 54 by a double-ended snap (not shown). In some embodiments, including the illustrated embodiment, attachment point 74 is detachably coupled to securement point 54 by engagement with clip 52. Handle 70 could be coupled to strap 12 in any suitable manner.

In some embodiments, when handle 70 is coupled to securement point 54 as aforesaid, handle 70 is thereby positioned at approximately the horse's wither when stirrup 10 and strap 12 are in use. Thus, a rider can reach up and pull on handle 70 to facilitate mounting the horse.

In some embodiments, strap 12 is provided with wither padding 80. In the illustrated embodiment, wither padding 80 is provided by a cushioned sleeve that includes a slot 82 through which strap 12 can be threaded. In use or during manufacture, wither padding 80 can be positioned on strap 12, for example by being slid onto second end 20 of mounting assist strap 12, and slid to a position along mounting assist strap whereby wither padding 80 sits over a horse's wither when strap 12 is in use. In some embodiments, wither padding 80 cushions the horse's withers when a rider is mounting the horse. In some embodiments, the wither strap is slid along mounting assist strap 12 to any desired location for a particular animal, for example on the animal's wither, beneath the animal's leg or armpit area, beneath securement point 54, or the like. Any suitable material can be used for the construction of wither padding 80, for example, leather, nylon, plastic, rubber, or the like.

Figure 7:
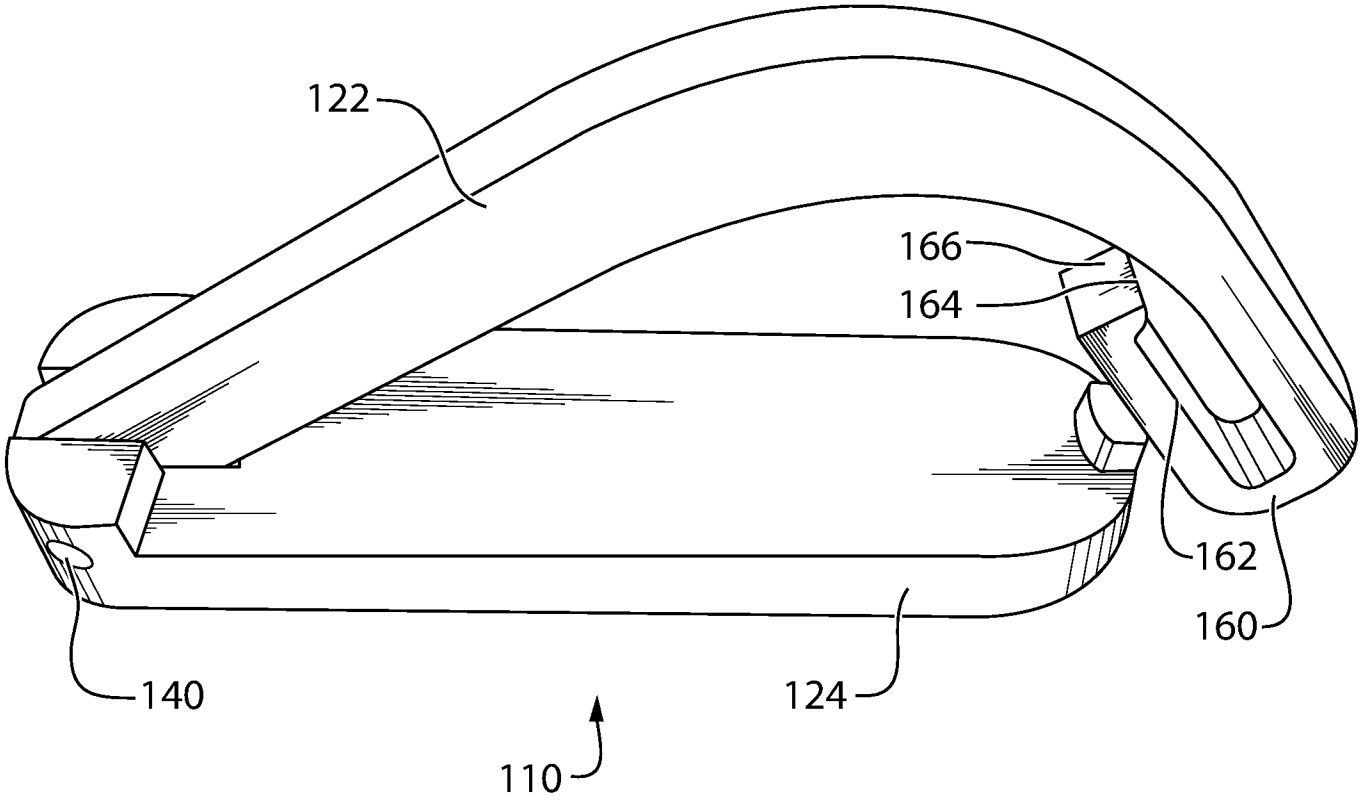
FIG. 7 shows a front view of a folding stirrup according to a second example embodiment in a folded configuration.

FIG. 7 shows a second exemplary embodiment of a foldable stirrup 110. Stirrup 110 is generally similar to stirrup 10, and like parts of foldable stirrup 110 have been identified with like reference numerals incremented by 100. Stirrup 110 differs from stirrup 10 primarily in that hook 28 has been replaced by a stirrup engagement member 160. Stirrup engagement member 160 is generally hook-shaped, and includes a relatively flat indentation 162 for receiving mounting assist strap 12 or a conventional stirrup leather, and a distal projection 164 at an outside edge 166 of the stirrup engagement member 160 for helping to hold mounting assist strap 12 or a conventional stirrup leather within stirrup engagement member 160 when stirrup 110 is engaged with mounting assist strap 12.

Figure 8:
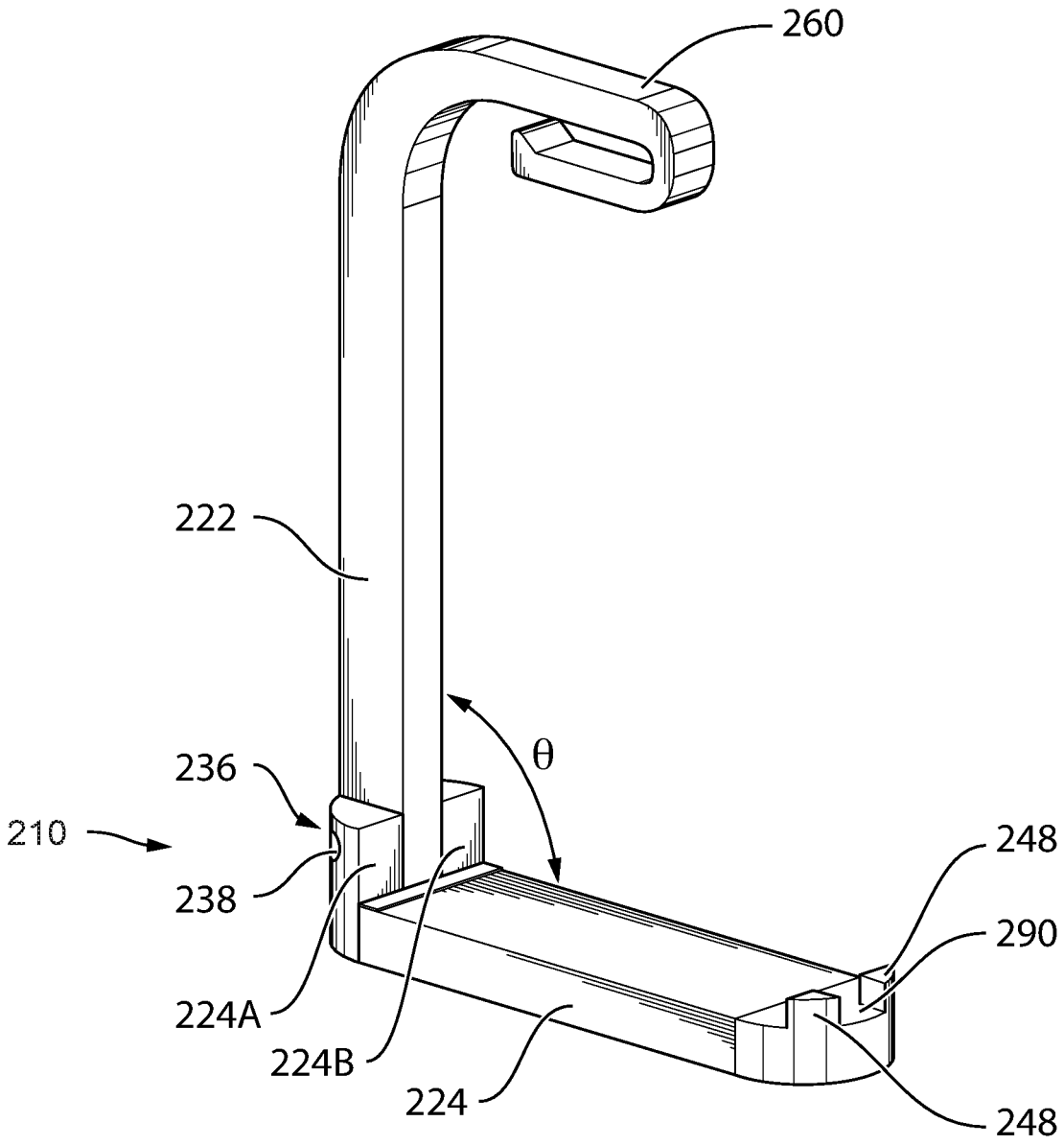
FIG. 8 shows a perspective view of a folding stirrup according to a third example embodiment in an open configuration.
Figure 9:
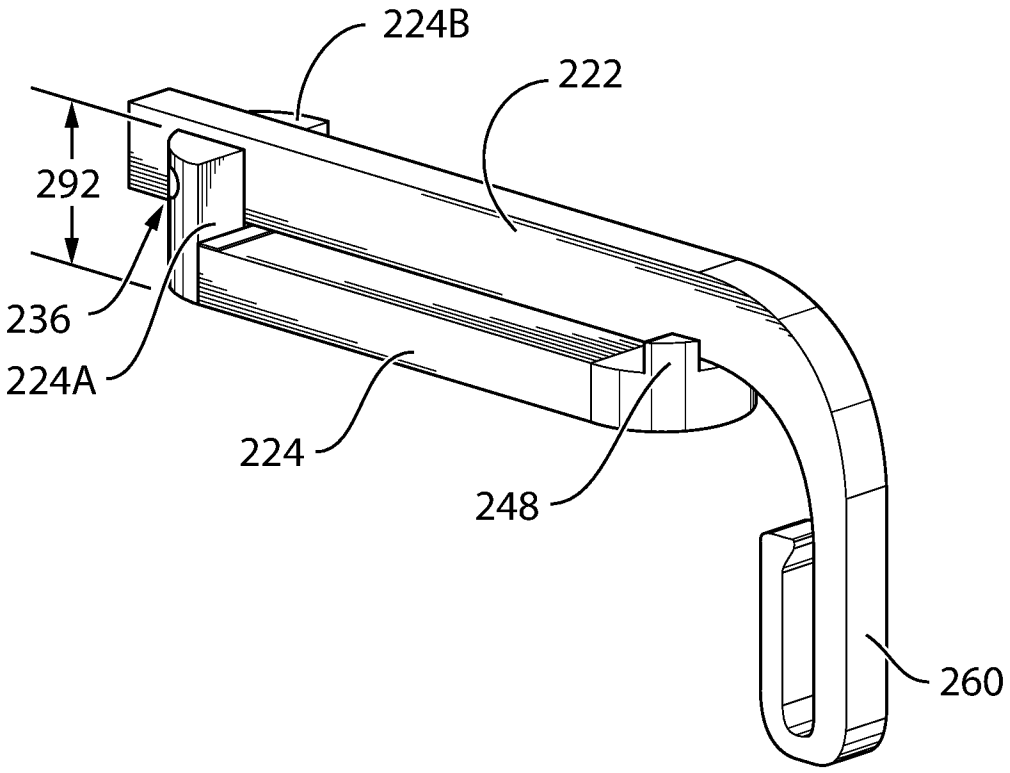
FIG. 9 shows a perspective view of the folding stirrup of FIG. 8 in a folded configuration.

FIG. 8 shows a third exemplary embodiment of a foldable stirrup 210 in an open configuration, and FIG. 9 shows stirrup 210 in the folded configuration. Stirrup 210 is generally similar to stirrup 10, and parts of foldable stirrup 210 that perform equivalent functions have been identified with like reference numerals incremented by 200. Stirrup 210 differs from stirrup 10 primarily in that the position of revolute joint 236 has been moved upwardly relative to base 224 by a distance sufficient to allow support arm 222 to be folded flat against base 224, i.e. to enable angle θ to be reduced to approximately 0° when stirrup 210 is in the folded configuration. In the illustrated embodiment, revolute joint 236 has been moved upwardly by increasing a height 292 of projections above base 224 so that revolute joint 236 can be moved upwardly (i.e. positioned farther away from) base 224. As can be seen in FIGS. 8 and 9, revolute joint 236 has been moved upwardly relative to base 224 by a sufficient distance that no cut-away portion (such as cut-away portion 44) is necessary in order to facilitate folding of support arm 222 against base 224.

To accommodate the folding of arm 222 flat against base 224, projection 248 differs from projection 48 by having a recessed portion 290 defined therein to receive arm 222, thereby allowing arm 222 to lie flat against base 224. In some embodiments, projection 248 is omitted altogether. Stirrup 210 is also provided with a stirrup engagement member 260, which is generally similar to stirrup engagement member 160.

Those skilled in the art will be able to select suitable materials for the manufacture of mounting assist strap 12 or 12' and foldable stirrup 10, 110 or 210. In some embodiments, mounting assist strap 12 or 12' is made from a piece of nylon webbing. Strap 12 or 12' could alternatively be made of leather or any other desired material sufficiently strong to hold the weight of a rider mounting a horse. In some embodiments, foldable stirrup 10, 110 or 210 is made from aluminum. In some embodiments, foldable stirrup 10, 110 or 210 could be made from stainless steel, heavy duty plastic, or other suitable material.

In use, strap 12 is passed over the back of a horse or other animal to be mounted. Strap 12 would generally lie across the back of the horse near the horse's wither. First end 14 of strap 12 is pulled by a user between the horse's forelegs, and clip 52 is pulled upwardly (typically on the right side of the horse where the rider is to mount from the horse's left side) and engaged with securement point 54 to provide a shoulder loop 16. Typically, but not necessarily, the shoulder loop 16 will be engaged with a horse's right shoulder (i.e. passed around the horse's right foreleg), given the convention that horses are typically mounted from the left side. Mounting strap 12 is reversible and can be used to mount a horse from either side, depending on what is comfortable for a rider.

Stirrup 10 (or stirrup 110 or stirrup 210) is engaged with loop 30 on the opposite side of the horse from the foreleg that is engaged with the shoulder loop 16. A rider inserts one foot (the rider's left foot in the case where the shoulder loop 16 is engaged with the horse's right foreleg) into stirrup 10, and swings his or her body up and onto the back of the horse.

In embodiments that include handle 70, the rider can couple handle 70 to strap 12 prior to use or just prior to mounting by engaging clip 52 with both attachment point 74 and securement point 54, or by engaging a double-ended snap or other connector to both attachment point 74 and securement point 54. The rider can then optionally pull on handle 70 to assist in mounting the horse.

In some embodiments, prior to mounting the horse, the rider can use slide 56 to adjust the size of shoulder loop 16 or the position of handle 70. In some embodiments, prior to mounting the horse, the rider can use slide 58 to adjust the height of stirrup 10 above the ground.

Once the rider is mounted, the rider can remove stirrup 10 from loop 30. In some embodiments, a kit including both a foldable stirrup 10 and a mounting assist strap 12, together with a small waist pack or backpack is provided. In such embodiments, the rider can fold stirrup 10 into the closed configuration and store the folded stirrup 10 in the pack. The rider can also remove mounting assist strap 12 from the horse by unclipping clip 52 from securement point 54 to release the foreleg engagement loop. The rider can then remove strap 12 by lifting it upwardly. In some embodiments, the rider stores strap 12 in a small waist pack or backpack after removing it from the horse. The rider can then ride or participate in other activities, carrying stirrup 10 and mounting assist strap 12 with them in case there is a need to dismount and re-mount, or to provide assistance in case the rider is thrown and needs to re-mount the horse.

While a number of exemplary aspects and embodiments are discussed herein, those of skill in the art will recognize certain modifications, permutations, additions and sub-combinations thereof. For example:

Stirrup 10 could be used with a conventional stirrup leather and saddle, for example where it is desired to mount a horse and practice riding without stirrups.

Stirrup 10 could be used in addition to a conventional stirrup leather and saddle to make it easier for a rider to mount an animal by hanging stirrup 10 below the conventional stirrup. A rider could then insert a first foot into stirrup 10, insert a second foot into the conventional stirrup, and mount the animal in conventional fashion. For example, where the rider is mounting from the animal's left side, stirrup 10 could be hung from the conventional stirrup on the animal's left side, the rider's right foot could be inserted into stirrup 10, the rider's left foot could be inserted into the conventional stirrup, and the rider's right leg swung over the animal's back to mount the animal.

Strap 12 could be used without stirrup 10 to facilitate mounting a horse (e.g. a rider could insert his or her foot into loop 30, rather than engaging stirrup 10 with loop 30), whether the rider is riding bareback or using a stirrupless bareback pad, or using a conventional saddle.

It is therefore intended that the following appended claims and claims hereafter introduced are interpreted to include all such modifications, permutations, additions and sub-combinations as are consistent with the broadest interpretation of the specification as a whole.

What is claimed is:

1. A foldable stirrup for mounting animals comprising:

a support arm for engagement with a strap; and a base comprising a generally flat portion for supporting a rider's foot while mounting when the stirrup is in an open configuration, a first end of the base being pivotably coupled to a first end of the support arm at a single joint, wherein each of the support arm and the base has a free second distal end opposite the first end, and wherein the support arm and the base are coupled together at only the singe joint;

a plane being defined by lines extending along a longitudinal axis of the first end of the support arm and a longitudinal axis of the base, the plane extending through the first end of the support arm, the base and the joint;

the base and the support arm being inwardly foldable together in the plane to a folded configuration in which a minimum angle that is defined between the first end of the support arm and the generally flat portion of the base about the joint is less than about 30°;

the support arm being shaped to define an open area between the support arm and the base into which the rider can easily insert their foot when the stirrup is in the open configuration.

2. The foldable stirrup as defined in claim 1, wherein the joint comprises a revolute joint.

3. A foldable stirrup as defined in claim 2, wherein the support arm and the base are coupled together by engagement of a pin through a pair of aligned apertures in the base and in the support arm.

4. A foldable stirrup as defined in claim 3, wherein a tip of the first end of the support arm is received between two projecting portions of the first end of the base, and wherein torsional movement or lateral movement in a direction parallel to a longitudinal axis of the pin of the base relative to the support arm is prevented by engagement of outer lateral surfaces of the tip with inner surfaces of the two projecting portions of the base.

5. The foldable stirrup as defined in claim 4, wherein an inner edge of the tip of the support arm squarely abuts a portion of the base defined between the two projecting portions of the base when the foldable stirrup is in the open configuration.

6. The foldable stirrup as defined in claim 3, wherein the support arm and the base are coupled together so that there is only one degree-of-freedom of relative movement of the support arm and the base.

7. The foldable stirrup as defined in claim 3, wherein a maximum angle that can be defined between the first end of the support arm and the generally flat portion of the base about the point is approximately 90°.

8. A foldable stirrup as defined in claim 3, wherein the minimum angle that can be defined between the first end of the support arm and the generally flat portion of the base is between about 10° and less than about 30°.

9. A foldable stirrup as defined in claim 3, wherein the minimum angle that can be defined between the first end of the support arm and the base is approximately 0°.

10. A foldable stirrup as defined in claim 9, wherein the revolute joint is positioned a sufficient distance above the base of the foldable stirrup to allow the minimum angle that can be defined between the first end of the support arm and the generally flat portion of the base about the point to be decreased to approximately 0°.

11. A foldable stirrup as defined in claim 9 comprising an upwardly extending projection on an upper surface of the base at a point distal from the support arm, wherein the upwardly extending projection comprises a recess for receiving the arm of the foldable stirrup when the foldable stirrup is in the folded configuration.

12. A foldable stirrup as defined in claim 3, wherein a portion of the support arm that is proximate to the base when the stirrup is in the folded configuration is cut away.

13. A foldable stirrup as defined in claim 12, wherein the cut-away portion comprises a catch surface for stopping further inward rotation of the support arm relative to the base when the stirrup is placed in the folded configuration.

14. A foldable stirrup as defined in claim 3, wherein the support arm comprises a hook-shaped stirrup engagement member having an indentation for receiving the strap and a distal projection at an outside edge of the stirrup engagement member for holding the strap in place.

15. The foldable stirrup as defined in claim 3, wherein the support arm comprises an arched portion extending between the first end of the support arm and the second end of the support arm, the arched portion allowing the second end of the support arm to engage with the strap and to extend in a direction generally perpendicular to the first end of the support arm that is pivotably coupled to the base at the joint.

* * * * *